US008375463B2

(12) United States Patent
Pickering

(10) Patent No.: US 8,375,463 B2
(45) Date of Patent: Feb. 19, 2013

(54) PARTIAL PROTECTIVE WEAR

(76) Inventor: Jennifer Pickering, Arlington Heights, IL (US)

( * ) Notice: Subject to any disclaimer, the term of this patent is extended or adjusted under 35 U.S.C. 154(b) by 266 days.

(21) Appl. No.: 12/655,707

(22) Filed: Jan. 6, 2010

(65) Prior Publication Data

US 2010/0125923 A1 May 27, 2010

Related U.S. Application Data

(63) Continuation-in-part of application No. 11/726,835, filed on Mar. 23, 2007, now abandoned.

(51) Int. Cl.
*A41D 13/08* (2006.01)

(52) U.S. Cl. ..... 2/16; 2/159; 2/163; 2/161.7; 2/161.6

(58) Field of Classification Search ..... 2/16, 159, 2/163, 167, 161.7, 161.6
See application file for complete search history.

(56) References Cited

U.S. PATENT DOCUMENTS 3,806,260 A 4/1974 Miller
5,251,335 A * 10/1993 DeFusco ..... 2/163
5,636,406 A 6/1997 Strong
5,901,378 A * 5/1999 Kirsch ..... 2/163
6,250,829 B1 6/2001 Brower et al.
6,298,491 B1 * 10/2001 Blustin et al. ..... 2/163
6,408,442 B1 * 6/2002 Kang ..... 2/167
6,536,970 B2 3/2003 Hauser et al.
6,550,065 B1 4/2003 Meyers
6,723,306 B2 4/2004 Gueret
2007/0083980 A1 * 4/2007 Yang et al. ..... 2/167

OTHER PUBLICATIONS

Evertan, www.evertan.com. "Three Quarter Collection", Mar. 7, 2005.*
Evertan, www.evertan.com, "Tees and Bags", Feb. 9, 2005.*

* cited by examiner

*Primary Examiner* — Alissa Tompkins
(74) *Attorney, Agent, or Firm* — Valauskas Corder LLC

(57) ABSTRACT

The present invention is partial protective wear for protecting the front surface of a hand, the palm, front surface of the fingers, side surface of the fingers, webs and nails. The partial protective wear includes a body with a periphery edge that defines a palm portion, finger portion, web portion and nail portion. The body includes an attachment side and a protective side. The attachment side releasably attaches the partial protective wear on the front surface of the hand. The palm portion protects the palm of the hand. The finger portion protects the front surface and side surface of the fingers of the hand. The nail portion protects the nail plates and nail grooves of the hand and the web portion protects the webs of the hand.

5 Claims, 6 Drawing Sheets

PARTIAL PROTECTIVE WEAR

This application is a continuation-in-part of application Ser. No. 11/726,835, filed on Mar. 23, 2007 now abandoned.

FIELD OF THE INVENTION

The present invention relates to protective wear and more particularly to protective wear that protects certain portions of the hand or foot.

BACKGROUND OF THE INVENTION

Basking in the sun is known to be bad for your skin and could lead to skin cancer. These risks have been alleviated with the introduction of self tanners. Self tanners include creams, lotions, gels, and sprays. Self tanners have a skin staining or coloration effect.

Self tanners affect any area of the skin to which it is applied. If protective hand and foot wear is not worn during application, the palms of hands, soles of feet, front surface and side surface of fingers, bottom surface and side surface of toes, webs between the fingers and toes, as well as nails are affected, and the discoloration is not easily removed.

Plastic or rubber gloves and socks can be used to prevent the self tanner from coming into contact with the palms, soles, fingers, toes, webs, and nails. However, gloves and socks prevent the self tanner from contacting the backside of hands and fingers as well as the topside of feet and toes resulting in a tan line around the wrists and ankles.

An applicator as disclosed in U.S. Pat. No. 5,636,406 teaches a pad that covers the palmar side of the hand, but does not protect the sides of fingers from coloration or staining. Further, the pad does not protect the webs and nails from coloration or staining.

There is a demand for protective wear that effectively guards the palms of hands, soles of feet, front surface and side surface of fingers, bottom surface and side surface of toes, webs, and nails from undesired staining or coloration, while allowing desired staining or coloration to the back surface of hands and fingers as well as the top surface of feet and toes. The present invention satisfies that demand.

SUMMARY OF THE INVENTION

The present invention effectively guards portions of a hand or foot from undesired staining or coloration as a result of self tanners. The present invention prevents self tanners from contacting those portions of the hands and feet covered by the partial protective wear. Although the present invention is discussed in reference to self tanners, the present invention is applicable to tanning outside under the sun or inside under artificial sun, e.g., tanning beds. The partial protective wear of the present invention allows desired staining or coloration to the back surface of hands and fingers as well as the top surface of feet and toes. For purposes of the application, the term "dorsum side" refers to the back surface of hands and fingers and the top surface of feet and toes. The term "palmar side" refers to the front surface of the hands and fingers—palms—and the bottom surface of the feet and toes—soles.

The present invention is applicable to any outdoor activity such as baseball, tennis, horseback riding, shoveling, etc., that may require protecting the hands or feet, and where one may want to tan their hands or feet during the outdoor activity. It is further contemplated that the present invention can be worn during the performance of any activity such as that performed by a money handler or bank teller, race car driver, mail sorter, and medical professional, to name a few.

In one embodiment, it is contemplated that the partial protective wear of the present invention protects the palmar side of hands, including the front surface of the fingers. In another embodiment, the partial protective wear further protects the nail plate including cuticles. It is further contemplated that the partial protective wear could additionally protect the webs, or loose skin between two fingers, as well as the sides of fingers.

It is also contemplated that the partial protective wear of the present invention protects the palmar side of feet, including the bottom surface of the toes. In another embodiment, the partial protective wear further protects the nail plate including cuticles. It is further contemplated that the partial protective wear could additionally protect the webs, or loose skin between two toes, as well as the sides of toes.

The partial protective wear may protect each finger and toe individually or all fingers and toes together, for example, such as that of a glove or mitten, respectively.

In one embodiment, the partial protective wear includes a body component with a periphery edge that defines a palm portion, finger portion, web portion, and nail portion. The palm portion protects or covers the palm of a hand. The finger portion protects or covers the front surface and side surface of fingers of a hand. The nail portion protects or covers the nails of a hand, and the web portion protects or covers the webs of a hand.

In another embodiment, the partial protective wear includes a body component with a periphery edge that defines a sole portion, toe portion, web portion, and nail portion. The sole portion protects or covers the sole of a foot. The toe portion protects or covers the bottom surface and side surface of toes of a foot. The nail portion protects or covers the nails of a foot, and the web portion protects or covers the webs of a foot.

It is further contemplated that the body includes an attachment side and a protective side. In one embodiment, the attachment side releasably attaches the partial protective wear on the front surface of a hand or the bottom surface of a foot. In another embodiment, the partial protective wear is slideably positioned such that the attachment side substantially abuts the front surface of a hand such as that of a glove, mitten, or the bottom surface of a foot such as that of a sock For purposes of this application, the term "web" designates the skin between two fingers or two toes. The term "nail" includes the nail plate, under the nail plate, and the nail groove including cuticle. The nail plate is the hard and translucent part, and sometimes extends past the end of a finger. The nail groove is the fold of the skin on the sides of the nail plate including cuticle at the proximal end of the nail.

The body component of the present invention is formed of an impermeable material such as synthetic resin, plastic, latex, rubber, cotton, rayon, nylon, polyester, spandex, or any combination thereof, or any material that is flexible yet resists self tanners such that the coloration or staining does not permeate the material and onto a hand or foot. Likewise, any material can be used that does not react with the self tanners, sun, or artificial sun. It is contemplated that the partial protective wear of the present invention can be made of a combination of materials, such as rubber for the attachment side and cotton for the protective side. Furthermore, the material can be waterproof.

In one embodiment, the body component may be made from a flexible material that includes application of the material in a liquid state that eventually solidifies to a solid or semi-solid state over the portions of the hands and feet to be protected. Examples of materials that can solidify to a solid or semi-solid state from a liquid state include, for example, latex, rubber, wax, composite material, epoxy, and polymers.

In embodiments where the body component includes an attachment side that releasably attaches to a hand or foot, the attachment side may include any substance disposed thereon that adheres or sticks to a surface of the skin and nails. Types of substances that may adhere or stick to the surface of the skin include adhesives such as natural, synthetic, drying, contact, reactive, light curing, heat activating and pressure sensitive adhesives.

In embodiments where the attachment side releasably attaches to the surface of skin, the present invention may include a removable liner covering the attachment side. The liner is removed from the body component to expose the adhesive substance on the attachment side in order to apply the body component to a hand or foot.

In one embodiment, the attachment side includes a pressure sensitive adhesive with attachment strength sufficient to hold the body component of the protective wear onto a hand or foot during use, but allow for the easy removal thereof after use.

It is also contemplated that the attachment side may adhere to a surface of the skin subsequent to the skin surface contacting the adhesive substance. The partial protective wear may also adhere to the surface of skin upon contact, for example, the human body heat activates the substance on the attachment side.

It is further contemplated that the present invention may include a tab portion along the periphery edge for ease of putting on or taking off the partial protective wear. Likewise, the nail portion of the body component can be pulled back from the nail to assist in the removal of the partial protective wear.

It is also contemplated that the protective side of the body component may further include a texture element. The texture element may assist in exfoliation of the skin surface during application of self tanners, for example, including coarse projections. It is also contemplated that the texture element may assist in grasping and handling items such as grip protuberances.

The present invention can include a moisturizer or conditioner on the body component and/or the back component. For example, a moisturizer may be on the attachment side and/or protective side of the body component to impart or restore hydration to the skin.

The present invention can be "one-size-fits-all". Other embodiments include various sizes, for example, small, medium and large. It is also contemplated that the periphery edge may include a plurality of removable, such as perforated, concentric rims. The removable rims allow the partial protective wear to fit a desired hand or foot size. In addition, the palm portion, sole portion, finger portion, toe portion, web portion and nail portion can each have a plurality of removable rims.

The present invention can be reusable or disposable.

In another embodiment, the partial protective wear further includes a back component that covers the dorsum side—back of a hand or top of a foot—that offers partial or no protection such as to allow desired staining or coloration. In applications to a hand, the back component includes a marginal edge that defines a back portion and a finger portion. In applications to a foot, the partial protective wear includes a back component with a marginal edge that defines a top portion and a toe portion.

The back component of the protective wear permits different absorption rates compared to other portions. For example, the palmar portion is made of a material that does not allow for absorption of the self tanner whereas the back portion is made of a material that allows for absorption of the self tanner to affect the staining or coloration of the skin.

The back component of the present invention is formed of a permeable material such as synthetic resin, plastic, latex, rubber, cotton, rayon, nylon, polyester, spandex, or any combination thereof, or any material that is flexible yet allows self tanners to permeate the material to allow desired coloration or staining on the hand or foot. Likewise, any material can be used that does not react with the self tanners, sun, or artificial sun. In one embodiment, the back component is of a material that is of a woven or intertwined structure with an open texture. Examples of woven structures include netting or mesh such as nylon mesh, metal wire mesh, fiberglass mesh, synthetic fiber mesh, or any mesh made from the materials described herein. Furthermore, the material can be waterproof.

In embodiments that include a back component, the partial protective wear includes a connection component that joins the periphery edge of the body component with the marginal edge of the back component. The connection component may be a sewn seam, Velcro®, adhesive such as glue or tape, or anything that joins the body component and the back component.

It is also contemplated that the partial protective wear may have adjustable features, such as a strap, to secure the partial protective wear onto a hand or foot.

In one embodiment, the partial protective wear has an adjustable feature in the form of a flap to accommodate various sizes of a hand or foot. The flap may be part of the body component or the back component such that it is positioned on or near the wrist or ankle. The wrist flap or ankle flap is flexible such that it is maneuverable such as folded or tucked under. For example, a wrist flap may be maneuvered to fully or partially tuck under the body component substantially abutting the attachment side to accommodate various sizes of a hand.

The present invention and its attributes and advantages will be further understood and appreciated with reference to the detailed description below of presently contemplated embodiments, taken in conjunction with the accompanying drawings.

DETAILED DESCRIPTION OF EMBODIMENTS OF THE INVENTION

For purposes of this application, the present invention is discussed in reference to hands, but the present invention is equally applicable to the feet.

Figure 1:
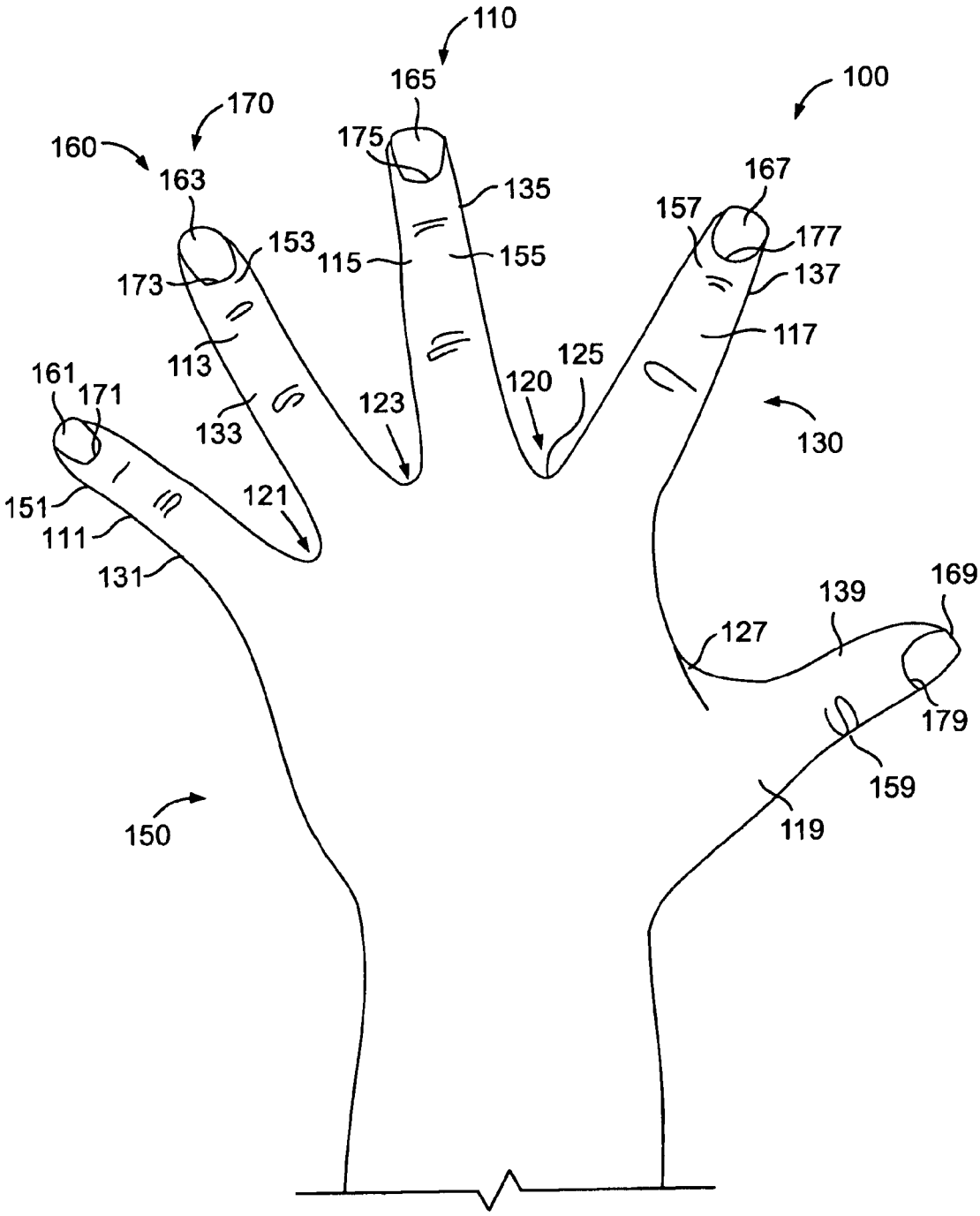
FIG. 1 is a back surface of a human hand.
Figure 2:
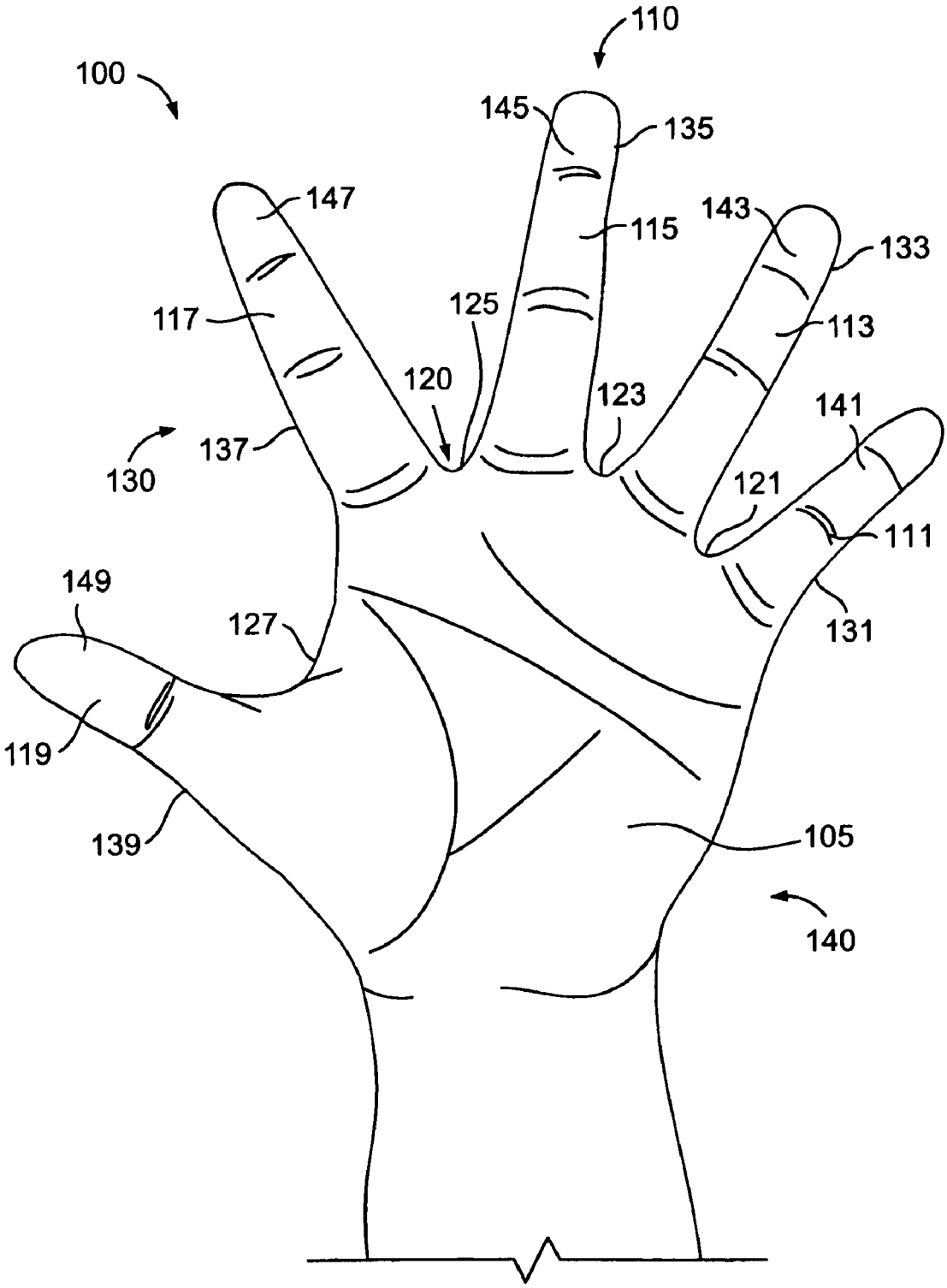
FIG. 2 is a front surface of a human hand.

As shown in FIGS. 1 and 2, hand 100 includes a front surface 140—palmar side—and back surface 150—dorsum side. Hand 100 includes palm 105, digits or fingers 110, webs 120, nail plates 160, and nail grooves 170. The first digit 111, otherwise referred to as little finger, second digit 113 (ring finger), third digit 115 (middle finger), fourth digit 117 (index finger) and fifth digit 119 (thumb finger) each include front surfaces 140, back surfaces 150 and side surfaces 130. Little finger 111 includes front surface 141, back surface 151 and side surface 131. Ring finger 113 includes front surface 143, back surface 153 and side surface 133. Middle finger 115 includes front surface 145, back surface 155 and side surface 135. Index finger 117 includes front surface 147, back surface 157 and side surface 137. Thumb finger 119 includes front surface 149, back surface 159 and side surface 139. Webs 120 include the loose skin between two fingers. First web 121 connects little finger 111 and ring finger 113. Second web 123 connects right finger 113 and middle finger 115. Third web 125 connects middle finger 115 and index finger 117. Fourth web 127 connects index finger 117 and thumb finger 119.

Nail plates 160 and nail grooves 170 are located on back surface 150. Little finger 111 includes nail plate 161 with nail groove 171. Ring finger 113 includes nail plate 163 with nail groove 173. Middle finger 115 includes nail plate 165 with nail groove 175. Index finger 117 includes nail plate 167 with nail groove 177. Thumb finger 119 includes nail plate 169 with nail groove 179.

Figure 3:
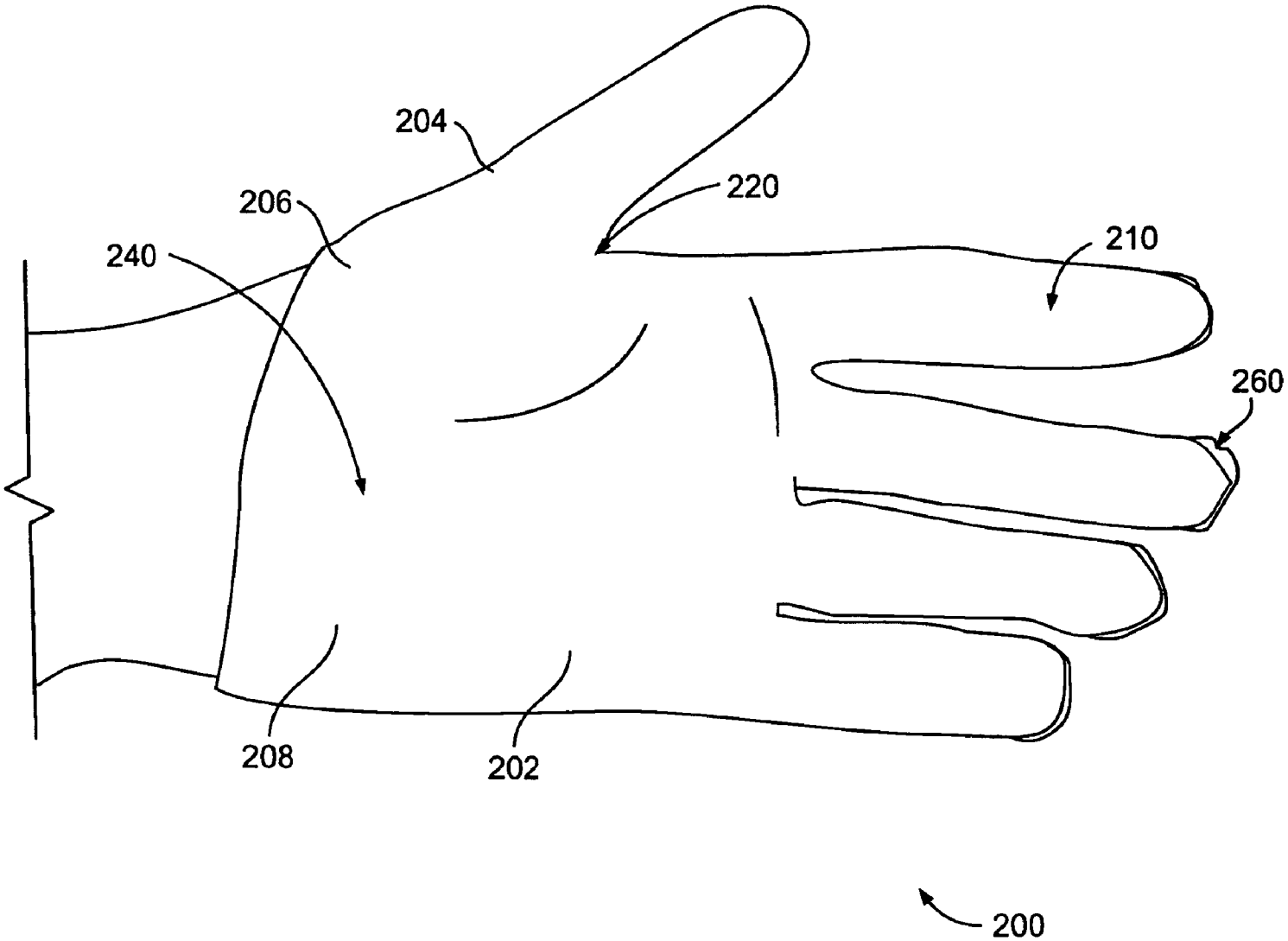
FIG. 3 is a bottom view of one embodiment of the partial protective wear configured to the human hand of FIGS. 1 and 2 according to the present invention.
Figure 4:
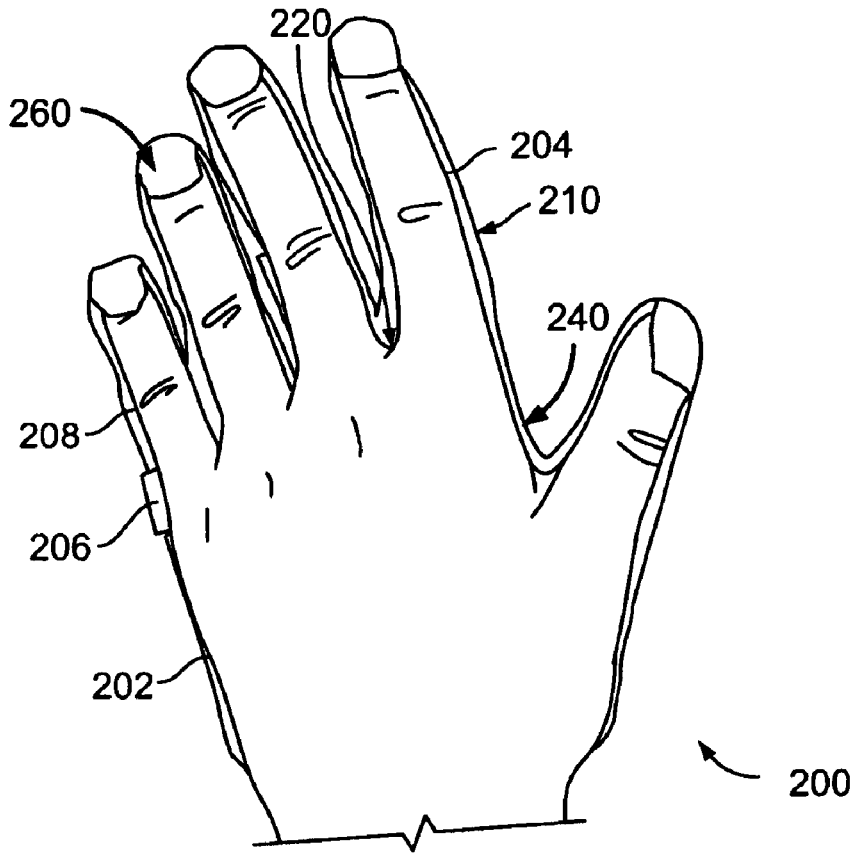
FIG. 4 is a top view of one embodiment of the partial protective wear configured to the human hand of FIGS. 1 and 2 according to the present invention.
Figure 5:
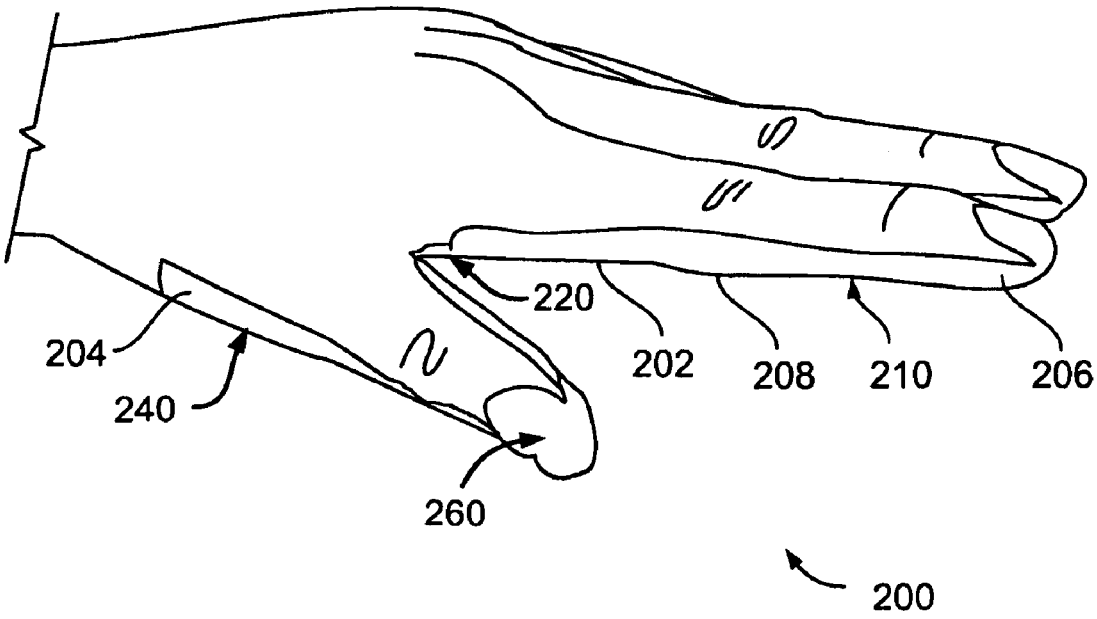
FIG. 5 is a side view of one embodiment of the partial protective wear configured to the human hand of FIGS. 1 and 2 according to the present invention.

FIGS. 3 through 5 illustrate the present invention configured to a human hand. The present invention is partial protective wear 200 for protecting the palmar side or front surface 140 of a hand including the palm, front surface of fingers, side surface of fingers, webs and nails. The partial protective wear 200 includes a body component 202 with a periphery edge 204 that defines a palm portion 240, finger portion 210, web portion 220 and nail portion 260. The body component 202 includes an attachment side 206 and a protective side 208. The attachment side 206 releasably attaches the partial protective wear 200 on the front surface 140 of the hand 100. The palm portion 240 protects the palm 105 of a hand 100. The finger portion 210 protects the front surface 140 and side surface 130 of fingers 110 of a hand 100. The nail portion 260 protects the nail plates 160 and nail grooves 170 of a hand 100 and the web portion 220 protects the webs 120 of a hand 100.

The attachment side 206 adheres the partial protective wear 200 to the hand 100 protecting the front surface 140, including areas of the palm 105, front surfaces 141, 143, 145, 147, 149 of fingers 110, side surfaces 131, 133, 135, 137 139 of fingers 110, webs 121, 123, 125, 127, nail plates 161, 163, 165, 167, 169 and nail grooves 171, 173, 175, 177, 179. The protective side 208 protects these areas from coloration or staining.

In one embodiment, a removable paper liner (not shown) is positioned over adhesive on the attachment side 206 until the partial protective wear 200 is to be used. Other embodiments include application to the hand a material that solidifies from a liquid state to form the partial protective wear. Other embodiments may include a pressure sensitive adhesive or heat activating adhesion.

With respect to embodiments with a removable paper liner, the adhesive on the attachment side 206 is exposed by removal of the paper liner. The body component 202 is attached by pressing the hand 100 onto the attachment side 206 such that the palm portion 240 covers the palm 105 of the hand 100, the finger portion 210 covers the front surface 140 and side surface 130 of the fingers 110, the web portion 220 covers the webs 120, and the nail portion 260 covers the nail plates 160 and nail grooves 170 by bending the nail portion 260 over the top of the fingers 110.

The attachment side 206 releasably attaches the body component 202 to the hand 100 while sealing the front surface 140 including the palm 105, side surface 130 of fingers 110, webs 120, nail plates 160 and nail grooves 170 from contact with the self tanner. The self tanner is applied to the skin. The partial protective wear 200 is removed by simply peeling the body component 202 from the hand 100. It is also contemplated that tabs (not shown) can assist in the removal of the body component 202 or one or more nail portion 260 can be pulled back from the nail plates 160 and nail grooves 170 to assist in the removal of the body component 202 from the hand 100.

Figure 6:
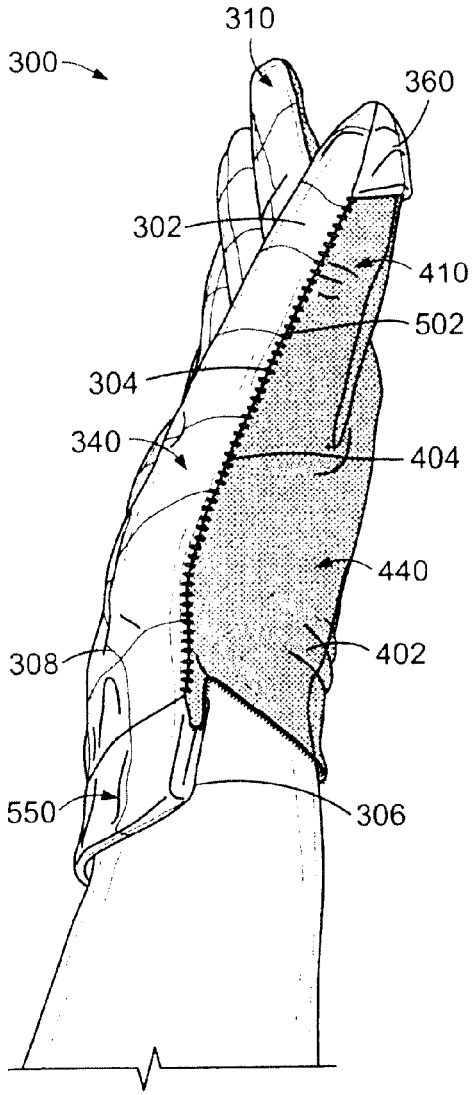
FIG. 6 is a side view of another embodiment of the partial protective wear configured to the human hand of FIGS. 1 and 2 according to the present invention.
Figure 7:
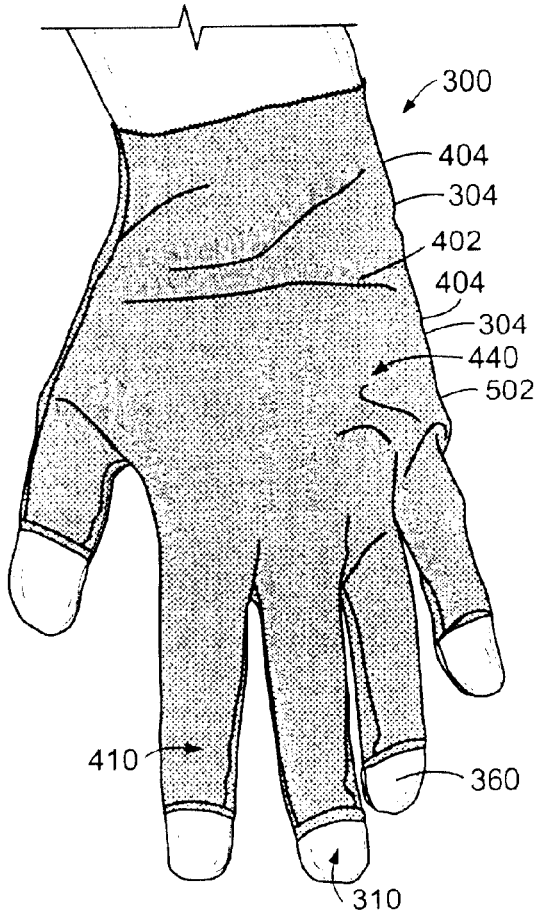
FIG. 7 is a top view of another embodiment of the partial protective wear configured to the human hand of FIGS. 1 and 2 according to the present invention.
Figure 8:
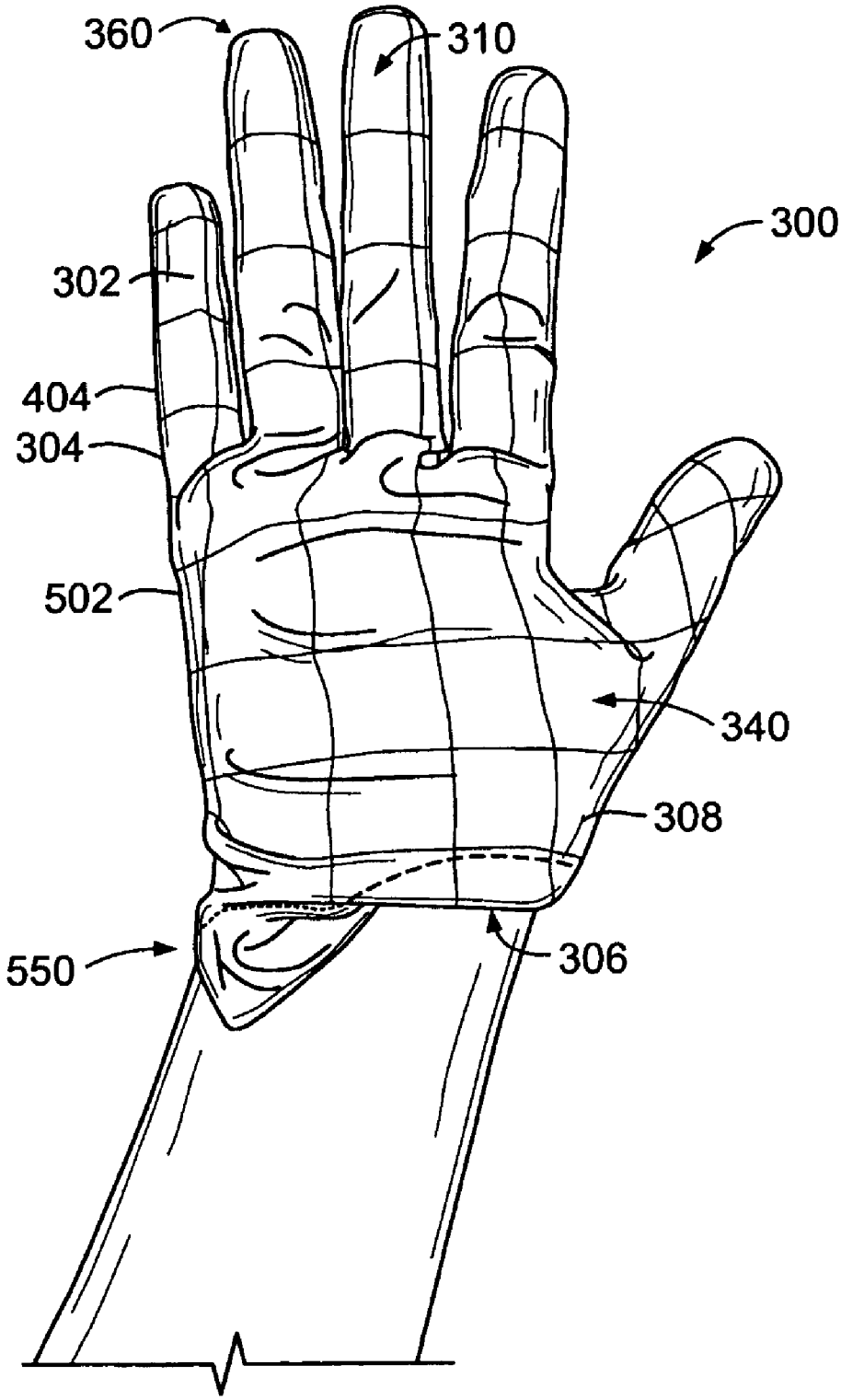
FIG. 8 is a bottom view of another embodiment of the partial protective wear configured to the human hand of FIGS. 1 and 2 according to the present invention.

FIGS. 6 through 8 illustrate another embodiment of the present invention configured to a human hand. The present invention is partial protective wear 300 for protecting the palmar side or front surface 140 (see FIG. 1) of a hand including the palm, front surface of fingers, and nails. The partial protective wear 300 includes a body component 302 and a back component 402 connected through a connection component 502.

The body component 302 includes a periphery edge 304 that defines a palm portion 340, finger portion 310, and nail portion 360. The body component 302 includes an attachment side 306 and a protective side 308. The attachment side 306 releasably attaches on the front surface 140 of the hand 100. The palm portion 340 protects the palm 105 of a hand 100 (see FIG. 1). The finger portion 310 protects the front surface 140 and side surface 130 of fingers 110 of a hand 100. The nail portion 360 protects the nail plates 160 and nail grooves 170 of a hand 100. In certain embodiments, the protective side 308 of the body component 302 may further include a texture element (not shown). The texture element may assist in exfoliation of the skin surface during application of self tanners or may assist in grasping and handling items.

As shown, the back component 402 includes a marginal edge 404 that defines a back portion 440 and a finger portion 410. The back portion 440 covers the dorsum side 150 or back of a hand 100 and the finger portion 410 protects or covers the back side of fingers 110 of a hand 100. As shown in FIGS. 6-8, a connection component 502 joins the periphery edge 304 of the body component 302 with the marginal edge 404 of the back component 402. Here, the connection component 502 is illustrated as a sewn seam.

The back component 402 of the protective wear 300 has a different absorption rate than the body component 302. For example, the body component 302 is made of an impermeable material that does not allow for absorption of the self tanner whereas the back component 402 is made of a permeable material that allows for absorption of the self tanner to affect the staining or coloration of the skin.

In certain embodiments, the partial protective wear 300 has an adjustable feature in the form of a wrist flap 550 to accommodate various sizes of a hand 100 (FIG. 1). The flap is shown as part of the body component 302, but it is contemplated that it can be part of the back component 402. The wrist flap 550 is flexible to be maneuverable such as folded or tucked under the attachment side 306 of the body component 302 as shown in FIG. 8. When folded or tucked under the attachment side 306 of the body component 302, the wrist flap 550 substantially abuts the attachment side 306.

The present invention is discussed in reference to self tanners, but it is contemplated the present invention can be utilized with other applications. For example, the protective side of the present invention can be composed of a sandpaper material for sanding surfaces.

As another example, the present invention can include a healing substance on the attachment side for application to injuries sustained on the palms of hands, soles of feet, sides of fingers and toes, webs between the fingers and toes, as well as nails. Likewise, a healing substance can be included on the protective side for application to injuries sustained on other parts of the body.

A gardener may utilize the present invention while gardening outside to allow the sun to tan the tops of the hands while preventing dirt and debris from contacting the palms, sides of fingers, webs and nails.

Besides protecting from self tanners, the present invention can be utilized to protect the palms of hands, sides of fingers, webs between the fingers, as well as nails during application of depilatory and bleaching products.

The present invention can be worn to protect the palms of hands, sides of fingers, webs between the fingers, as well as nails from the handling of materials, for example money, coins, cards, artwork, etc.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. Protective wear that guards certain portions of a hand of a wearer from undesired staining from self tanners while allowing desired coloration to other certain portions of the hand of the wearer, wherein the hand of the wearer includes a palmar side and a dorsum side, the protective wear comprising:

a body component including a periphery edge defining a palm portion covering the palmar side of the hand of the wearer and a first finger portion covering the palmar side of one or more fingers of the wearer, wherein said first finger portion further includes a nail portion covering all of the nail plate, nail groove, and cuticle of one or more nails on the dorsum side of the hand of the wearer, said body component made of an impermeable material thereby configured to not permit staining from a self tanner;

a back component including a marginal edge defining a back portion covering the dorsum side of the hand of the wearer and a second finger portion covering the dorsum side of one or more fingers of the wearer, said back component made of a permeable material thereby configured to permit coloration from a self tanner; and a connection component, wherein said connection component is a sewn seam that joins said periphery edge of said body component made of the impermeable material with said marginal edge of said back component made of the permeable material.

2. The protective wear of claim 1 further comprising a flexible wrist flap component, wherein said flexible wrist flap component extends from said body component such that said flexible wrist flap component is positioned over the palmar side of the wrist of the wearer, said flexible wrist flap component is maneuverable to accommodate various sizes of the palmar side of the hand of the wearer.

3. The protective wear of claim 1 further comprising a flexible wrist flap component, wherein said flexible wrist flap component extends from said back component such that said flexible wrist flap component is positioned over the dorsum side of the wrist of the wearer, said flexible wrist flap component is maneuverable to accommodate various sizes of the dorsum side of the hand of the wearer.

4. The protective wear of claim 1, wherein said permeable material is a nylon mesh.

5. The protective wear of claim 1, wherein said impermeable material is plastic.

* * * * *